US005299486A

United States Patent [19]

Weingrill

[11] Patent Number: 5,299,486

[45] Date of Patent: Apr. 5, 1994

[54] MOUNTING ARRANGEMENT FOR A KEY SHAFT IN A MUSICAL INSTRUMENT

[75] Inventor: Roberto Weingrill, Sao Paulo, Brazil

[73] Assignee: Weril Instrumentos Musicais Ltd., Franco da Rocha, Brazil

[21] Appl. No.: 899,027

[22] Filed: Jun. 15, 1992

Related U.S. Application Data

[63] Continuation of Ser. No. 670,936, Mar. 18, 1991, abandoned.

[51] Int. Cl.[5] ..... G10D 7/00; G10D 7/08

[52] U.S. Cl. ..... 84/380 R; 84/385 R

[58] Field of Search ..... 84/386, 385 R, 384, 84/381, 380 R

[56] References Cited

U.S. PATENT DOCUMENTS

| | | | |
|---|---|---|---|
| 1,345,486 | 7/1920 | Gulick | 84/385 R |
| 2,090,011 | 8/1937 | Selmer | 84/385 R |
| 2,744,435 | 5/1956 | Anderson et al. | 84/380 R |
| 2,895,578 | 7/1959 | Winchell | 84/380 R |
| 3,421,398 | 1/1969 | Whiteside et al. | 84/380 R |
| 3,865,005 | 2/1975 | Carree | 84/380 R |

*Primary Examiner*—Michael L. Gellner
*Assistant Examiner*—Cassandra C. Spyrou
*Attorney, Agent, or Firm*—Jacobson, Price, Holman & Stern

[57] ABSTRACT

A mounting arrangement for the key shaft of a musical instrument which has a finger pad and a key attached to the shaft for operating a valve on the instrument when the finger pad is moved is herein disclosed. The mounting arrangement includes a bearing at each end of the shaft, a blind hole in each end of the shaft, an elongated tapered pin in each blind hole, a spring in each blind hole urging the respective pin outwardly, and a tapered bore in each bearing receiving the respective pin. Also, each bearing has an extension to the bore, forming a lubrication passage.

2 Claims, 1 Drawing Sheet

MOUNTING ARRANGEMENT FOR A KEY SHAFT IN A MUSICAL INSTRUMENT

This is a continuation of application Ser. No. 07/670,936, filed Mar. 18, 1991, which was abandoned upon the filing hereof.

BACKGROUND OF THE INVENTION

The present descriptive report deals with a request of Patent for an innovative model of joint shaft guide for the mechanism of the musical instrument keys, which has specific characteristics providing a large practicality and utility for the purpose it is intended.

As we know, there is a model of joint shaft guide in the market, which is mounted in the end of a triangle having a rotary movement of the musical instrument keys. The triangle has in its end a cylindrical hole which receives a spring and an articulation part, having a rotation susceptible of sliding within the mentioned hole. The articulation part has in its outside end an empty space which receives coaxially the terminal tip of a screw having a tip fixed within a ball body which is a support of articulation.

The mentioned model has a certain cost in front of the number of pieces that compose it, which are commonly used in the market and further, a certain grade of difficulty in lubrication, and mounting and dismounting of them.

SUMMARY OF THE INVENTION

In accordance with the invention there is provided a mounting arrangement for a key shaft of a musical instrument, the shaft having a finger pad and a key attached thereto for operating a valve on the instrument when the finger pad is moved, the mounting arrangement comprising bearings on the instrument in which opposite ends of the shaft are journalled, and the arrangement including a blind bore in one end of the shaft, and elongate tapered pin in the blind bore, a spring in the blind bore urging the pin outwardly and a tapered bore in one of the bearings receiving the pin. Preferably, there is a cylindrical lubrication passage formed through said one of the bearings which communicates with the tapered bore.

Through this mechanism, it will be possible to eliminate plays which formerly occurred due to the frictional wear of the parts, since as the pin tears, this, by means of the helical spring, remains in its place, thus reducing the play caused by leakages and complementary noises to zero. The mounting and dismounting of such a mechanism will be fast, being sufficient for this purpose, to insert the hole into the pin, thus compressing the spring and further, it has the advantage of the instrument cost through the elimination of screws and threads commonly used in saxophones.

The present Patent is characterized by its structural simplicity and facility of mounting and dismounting, aiming also to provide a model of easy execution and low cost for its industrial viability, but together the requirements of robustness, safety and practicality, providing to the consumers an additional option in the similar markets.

BRIEF DESCRIPTION OF DRAWINGS

In order to rather clear the present descriptive report, we attach drawings which contain the following references.

DESCRIPTION OF PREFERRED EMBODIMENT

Figure 1:
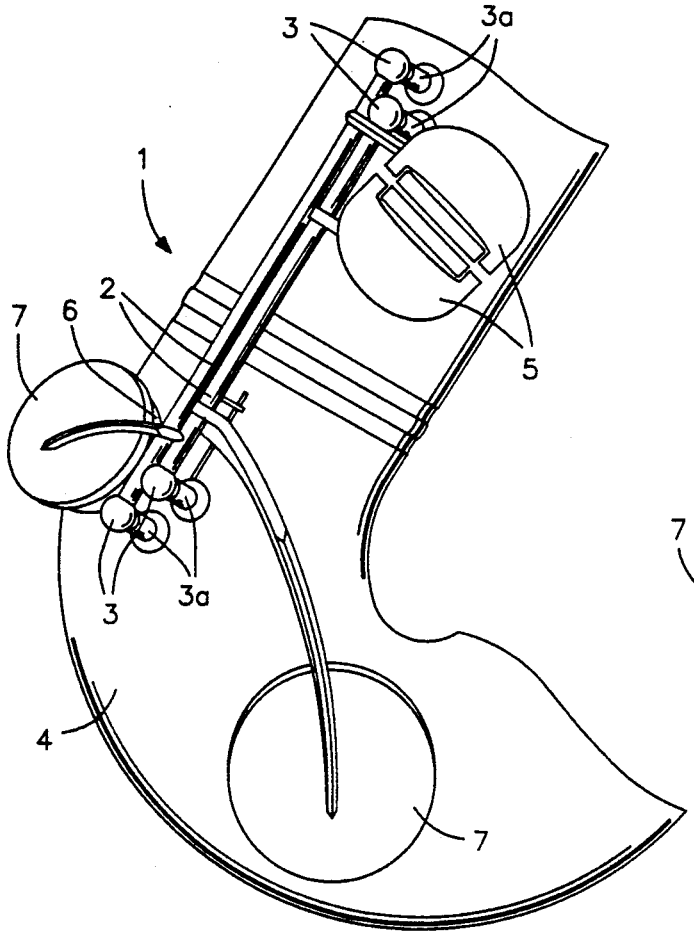
FIG. 1: shows a side view, in perspective, of the assembly.

FIG. 1 shows a saxophone 1 having a main body 4 with key shafts 2 mounted thereon, as will be described, for selectively opening valves 6 by means of keys 7 carried by the respective shafts. The shafts and keys are operated by finger pads 5 in known manner. The shafts 2 are journalled at their opposite ends in bearings 3 shaped as balls atop posts **3*a*** on the saxophone body.

Figure 2:
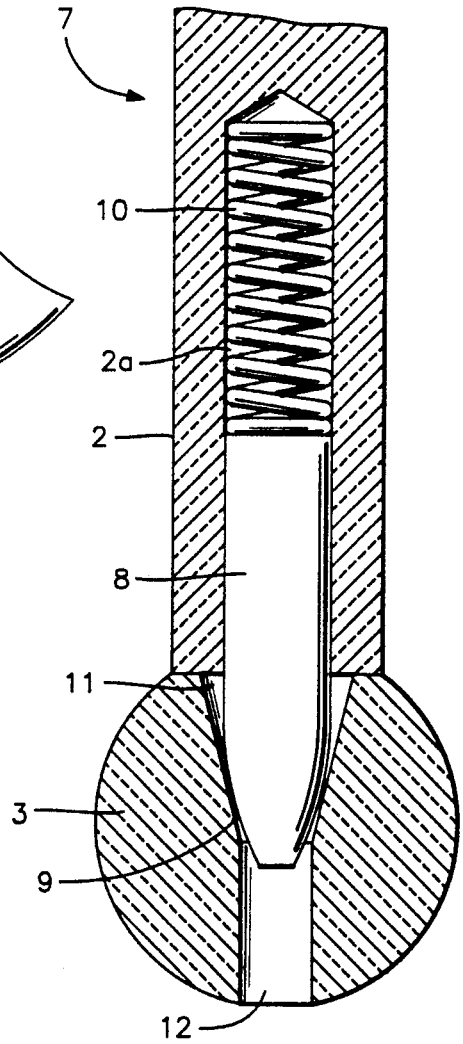
FIG. 2: shows a detailed view of the joint shaft guide.

As shown in FIG. 2, the end of a shaft 2 has a blind bore **2*a* in which is mounted an elongate tapered pin 8 urged outwardly by a spring 10. The tapered end 9 of the pin fits in a tapered bore 11 in a respective bearing 3. The tapered bore 11 leads into a coaxial lubrication passage 12** formed through the bearing.

The present descriptive report deals, therefore, with a new concept of a joint shaft guide, which presents several differences in front of the conventional models existing in the market, in addition to technical, constructive and functional characteristics entirely different to those pertinent to the technical state.

I claim:

1. A mounting arrangement for a key shaft of a musical instrument, said shaft having a finger pad and a key attached thereto for operating a valve on the instrument when the finger pad is moved, the mounting arrangement comprising bearings on the instrument in which opposite ends of the shaft are journalled, the arrangement including a blind bore in one end of the shaft, an elongate tapered pin in the blind bore, a spring in the blind bore urging the pin outwardly, and a tapered bore in one of said bearings receiving the pin.

2. An arrangement as claimed in claim 1 further including a cylindrical lubrication passage formed through said one bearing communicating with the tapered bore.

* * * * *